US009640162B2

(12) United States Patent
Ball et al.

(10) Patent No.: US 9,640,162 B2
(45) **Date of Patent: *May 2, 2017**

(54) MUSICAL INSTRUMENT SWITCHING SYSTEM

(71) Applicant: Ernie Ball, Inc., San Luis Obispo, CA (US)

(72) Inventors: Sterling Ball, La Quinta, CA (US); Drew Thomas Montell, Templeton, CA (US); Robert James Wolstein, Templeton, CA (US); Dudley Dean Gimpel, Atascadero, CA (US); Christopher Pullen Stephens, Templeton, CA (US)

(73) Assignee: Ernie Ball, Inc., San Luis Obispo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/879,201

(22) Filed: Oct. 9, 2015

(65) Prior Publication Data

US 2016/0049140 A1 Feb. 18, 2016

Related U.S. Application Data

(63) Continuation of application No. 13/192,115, filed on Jul. 27, 2011, now Pat. No. 9,196,235.

(60) Provisional application No. 61/368,514, filed on Jul. 28, 2010.

(51) Int. Cl.

| | |
|---|---|
| ***G10H 1/00*** | (2006.01) |
| ***G10H 1/18*** | (2006.01) |
| ***G10H 1/46*** | (2006.01) |
| ***G10H 3/18*** | (2006.01) |

(52) U.S. Cl.

CPC ..... *G10H 1/18* (2013.01); *G10H 1/46* (2013.01); *G10H 3/188* (2013.01)

(58) Field of Classification Search

CPC ..... G10H 2230/115; G10H 2230/095; G10H 2230/101; G10H 3/26; G10H 1/0066; G10H 2230/145; G10H 1/46; G10H 3/18; G10H 1/00; G10H 1/40; G10H 1/0083; G10H 1/32; G10H 2230/151; G10H 2230/085;

(Continued)

(56) References Cited

U.S. PATENT DOCUMENTS

| | | | |
|---|---|---|---|
| 4,236,436 | A | 12/1980 | Dietrich et al. |
| 4,653,376 | A | 3/1987 | Allured et al. |
| 4,794,838 | A | 1/1989 | Corrigau, III |

(Continued)

OTHER PUBLICATIONS

Korean Intellectual Property Office, International Search Report issued in PCT/US2011/045766, Jan. 11, 2012, 4 pages.

(Continued)

*Primary Examiner* — Marlon Fletcher
(74) *Attorney, Agent, or Firm* — Jeffrey G. Sheldon; Leech Tishman Fuscaldo & Lampl

(57) ABSTRACT

A musical instrument switching system includes a) a control circuit controllable for combining and routing the analog audio, the control circuit comprising a plurality of instrument pickups for transmitting analog audio, and a controller connector for allowing connection of the control circuit to a computing device, and b) a software program, installable in the computing device, for modifying the characteristics of the musical instrument.

10 Claims, 3 Drawing Sheets

(58) Field of Classification Search
CPC ..... G10H 2230/105; G10H 2220/135; G10H 2210/066
See application file for complete search history.

(56) References Cited

U.S. PATENT DOCUMENTS

| | | | | |
|---|---|---|---|---|
| 4,901,618 | A | 2/1990 | Blum, Jr. | |
| 5,025,703 | A | 6/1991 | Iba et al. | |
| 5,121,669 | A | 6/1992 | Iba et al. | |
| 5,220,117 | A | 6/1993 | Yamada et al. | |
| 5,266,735 | A | 11/1993 | Shaffer et al. | |
| 5,408,911 | A | 4/1995 | Weiss et al. | |
| 5,561,257 | A | 10/1996 | Cardey, III et al. | |
| 5,744,744 | A | 4/1998 | Wakuda | |
| 5,780,760 | A | 7/1998 | Riboloff | |
| 5,786,541 | A | 7/1998 | Komano et al. | |
| 5,789,689 | A | 8/1998 | Doidic et al. | |
| 5,837,912 | A | 11/1998 | Eagen | |
| 5,866,834 | A | 2/1999 | Burke et al. | |
| 5,929,360 | A | 7/1999 | Szalay | |
| 5,990,411 | A | 11/1999 | Kellar | |
| 6,075,194 | A | 6/2000 | Marinic et al. | |
| 6,121,537 | A | 9/2000 | Pawar et al. | |
| 6,162,981 | A | 12/2000 | Newcomer et al. | |
| 6,166,313 | A | 12/2000 | Miyamoto | |
| 6,191,350 | B1 | 2/2001 | Okulov et al. | |
| 6,242,682 | B1 | 6/2001 | Marinic et al. | |
| 6,259,015 | B1 | 7/2001 | Takahashi et al. | |
| 6,320,113 | B1 | 11/2001 | Griffin et al. | |
| 6,350,942 | B1 | 2/2002 | Thomson | |
| 6,437,226 | B2 | 8/2002 | Oudshoorn et al. | |
| 6,664,460 | B1 | 12/2003 | Pennock et al. | |
| 6,846,980 | B2 | 1/2005 | Okulov | |
| 6,995,311 | B2 | 2/2006 | Stevenson | |
| 6,998,529 | B2 | 2/2006 | Wnorowski | |
| 7,038,123 | B2 | 5/2006 | Ludwig | |
| 7,176,373 | B1 | 2/2007 | Longo | |
| 7,276,657 | B2 | 10/2007 | Bro et al. | |
| 7,279,631 | B2 | 10/2007 | Celi et al. | |
| 7,289,633 | B2 | 10/2007 | Metcalf | |
| 7,355,110 | B2 | 4/2008 | Nash | |
| 7,399,918 | B2 | 7/2008 | Juszkiewicz et al. | |
| 7,432,435 | B2 | 10/2008 | Tamura et al. | |
| 7,482,531 | B2 | 1/2009 | Doering | |
| 7,521,628 | B2 | 4/2009 | Armstrong-Muntner | |
| 7,536,257 | B2 | 5/2009 | Nishibori et al. | |
| 7,538,269 | B2 | 5/2009 | Ekstrom | |
| 7,541,536 | B2 | 6/2009 | Daniel | |
| 7,563,977 | B2 | 7/2009 | Cummings | |
| 7,601,908 | B2 | 10/2009 | Ambrosino | |
| 7,612,278 | B2 | 11/2009 | Sitrick et al. | |
| 7,799,986 | B2 | 9/2010 | Ryle et al. | |
| 8,319,088 | B1 | 11/2012 | Harari | |
| 8,569,608 | B2 | 10/2013 | Moon | |
| 8,796,531 | B2 | 8/2014 | Ambrosino | |
| 9,196,235 | B2 * | 11/2015 | Ball | G10H 1/18 |
| 2002/0005108 | A1 * | 1/2002 | Ludwig | G10H 1/00 84/600 |
| 2003/0052728 | A1 | 3/2003 | Philpott | |
| 2003/0196542 | A1 | 10/2003 | Harrison, Jr. | |
| 2004/0187673 | A1 | 9/2004 | Stevenson | |
| 2005/0039594 | A1 | 2/2005 | Dubal | |
| 2005/0120870 | A1 * | 6/2005 | Ludwig | G10H 1/00 84/661 |
| 2005/0126372 | A1 * | 6/2005 | Ludwig | G10H 1/32 84/645 |
| 2006/0243123 | A1 | 11/2006 | Ierymenko | |
| 2007/0051226 | A1 | 3/2007 | Diaz | |
| 2007/0227344 | A1 | 10/2007 | Ryle et al. | |
| 2007/0234880 | A1 | 10/2007 | Adams et al. | |
| 2007/0251374 | A1 | 11/2007 | Armstrong-Muntner | |
| 2008/0173162 | A1 | 7/2008 | Williams | |
| 2008/0271594 | A1 | 11/2008 | Starr | |
| 2009/0139390 | A1 | 6/2009 | Raisanen | |
| 2010/0037755 | A1 | 2/2010 | McMillen et al. | |
| 2010/0263521 | A1 | 10/2010 | Ierymenko et al. | |
| 2011/0303075 | A1 | 12/2011 | McMillen et al. | |
| 2012/0024129 | A1 * | 2/2012 | Ball | G10H 1/18 84/602 |
| 2012/0036983 | A1 | 2/2012 | Ambrosino | |
| 2012/0294457 | A1 | 11/2012 | Chapman et al. | |

OTHER PUBLICATIONS

Korean Intellectual Property Office, Written Opinion issued in PCT/US2011/045766, Jan. 11, 2012, 5 pages.

* cited by examiner

MUSICAL INSTRUMENT SWITCHING SYSTEM

RELATED APPLICATIONS

This application is a continuation of U.S. application Ser. No. 13/192,115, filed on Jul. 27, 2011, entitled "MUSICAL INSTRUMENT SWITCHING SYSTEM", which claims priority from U.S. Provisional Application No. 61/368,514, filed on Jul. 28, 2010, entitled "MUSICAL INSTRUMENT SWITCHING SYSTEM."

FIELD OF THE INVENTION

The invention pertains to the field of signal switching systems, and, more specifically, to signal switching systems used in musical instruments for combining and routing audio and instrument sound pickup devices.

BACKGROUND OF THE INVENTION

There are numerous systems, devices and methods for combining instrument sound pickup devices. Among these systems are manual and preset combination circuits.

Manual combination circuits have been used on instruments, such as, for example, electric guitars for many years. Advantageously, manual combination circuits are relatively inexpensive to manufacture and do not require any programming to combine the signals from various pickups. However, manual combination circuits entail several problems.

A first problem with manual combination circuits is that they are limited in number of combinations that a musician can memorize and/or access. Secondly, manual combination circuits are limited to the number of physical switches that can be placed on an instrument. For example, it would be impractical to have a hundred or more physical switches on an instrument to provide the equivalent number of combinations. Thirdly, manual combination circuits require physical rewiring that are cumbersome and require skills that the user often does not possess. Fourthly, if the switching combination is complex, the ability to change combinations with a manual combination circuit must generally be limited, to prevent the signal stream from being interrupted.

Preset combination circuits, by comparison, are more efficient because all of the combinations are permanently preset during the manufacturing process. Disadvantageously, however, permanently preset combination circuits limit the repertoire of the musician. The musician can only combine signals in the presets.

Therefore, there exists a need for a musical instrument switching system for combining and routing a plurality of audio and/or instrument sound pickup devices which avoids these problems in the prior art.

SUMMARY OF THE INVENTION

The invention satisfies this need. The invention is a musical instrument comprising a) a control circuit 200 controllable for combining and routing the analog audio, the circuit 200 comprising a plurality of instrument pickups 202 for transmitting analog audio, and a controller connector for allowing connection of the circuit to a computing device, and b) a software program, installable in the computing device, for modifying the characteristics of the musical instrument.

The invention is also a method of playing a musical instrument having the musical instrument switching system described above. The method comprises the steps of a) presetting the computing device to change one or more of the characteristics of the musical instrument, b) selecting one or more of the characteristics, c) activating the selected characteristics, d) playing the musical instrument with the selected characteristics, e) selecting a different characteristic than was selected in step c) on the external computing device; and f) repeating steps c and d.

The invention employs a digitally controlled device (matrix) to connect multiple pickup devices, each with a plurality of electrical connection points, in any combination possible of those connection points, to produce a wide variety of sounds, and that any possible combination of the connection points can be programmed and saved to be recalled using controls on the instrument or by external control devices.

DRAWINGS

These and other features, aspects and advantages of the present invention will become better understood with reference to the following description, appended claims and accompanying drawings where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

According to one aspect of the present invention, there is provided a musical instrument switching system using hardware and software for combining and routing a plurality of audio, instrument sound pickup, or both audio and instrument sound pickup devices that is easy to use and modifiable during use. According to another aspect of the present invention, there is provided a method for using a musical instrument switching system using hardware and software for combining and routing a plurality of audio, instrument sound pickup, or both audio and instrument sound pickup devices that is easy to use and modifiable during use.

Figure 2:
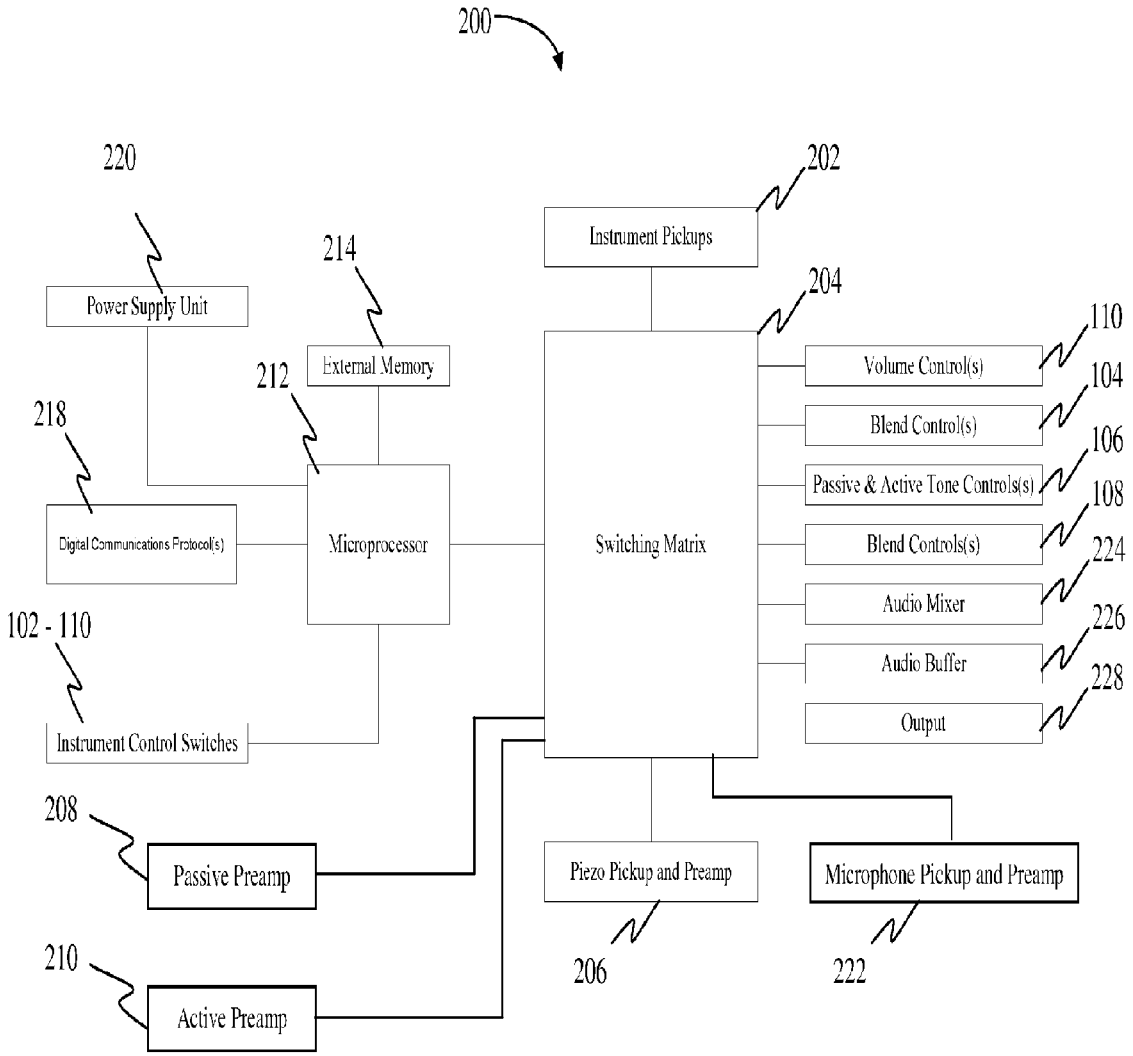
FIG. 2 is a block diagram of a control circuit for a musical instrument switching system having features of the invention.
Figure 3:
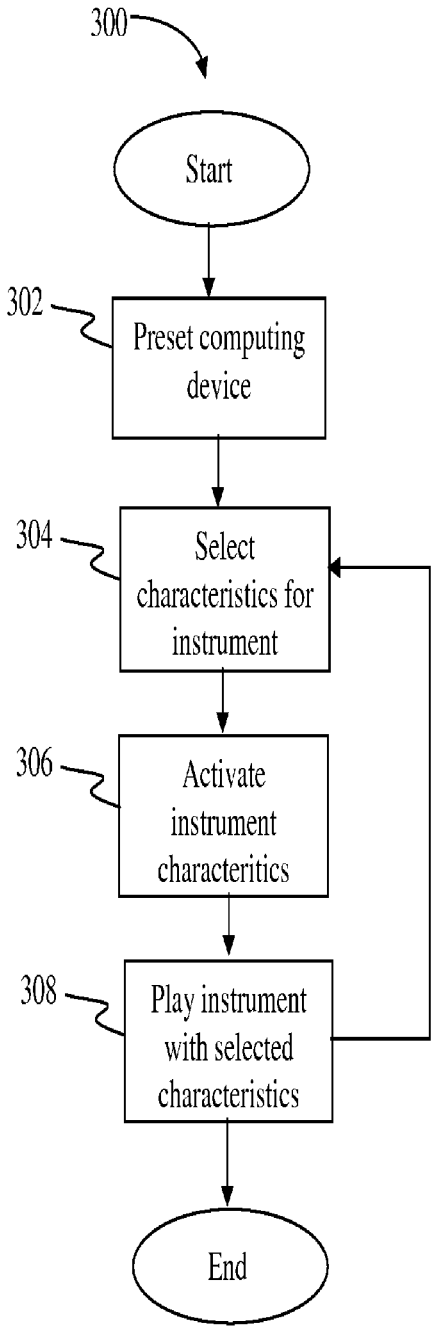
FIG. 3 is a flowchart of steps in a method of playing the musical instrument of FIG. 1.

The musical instrument switching system 10 of the invention comprises a) a control circuit 200 for combining and routing analog audio connected to a plurality of musical instrument pickups 202, and b) a software program 12. One embodiment of this aspect of the invention is illustrated in FIGS. 1-3.

Figure 1:
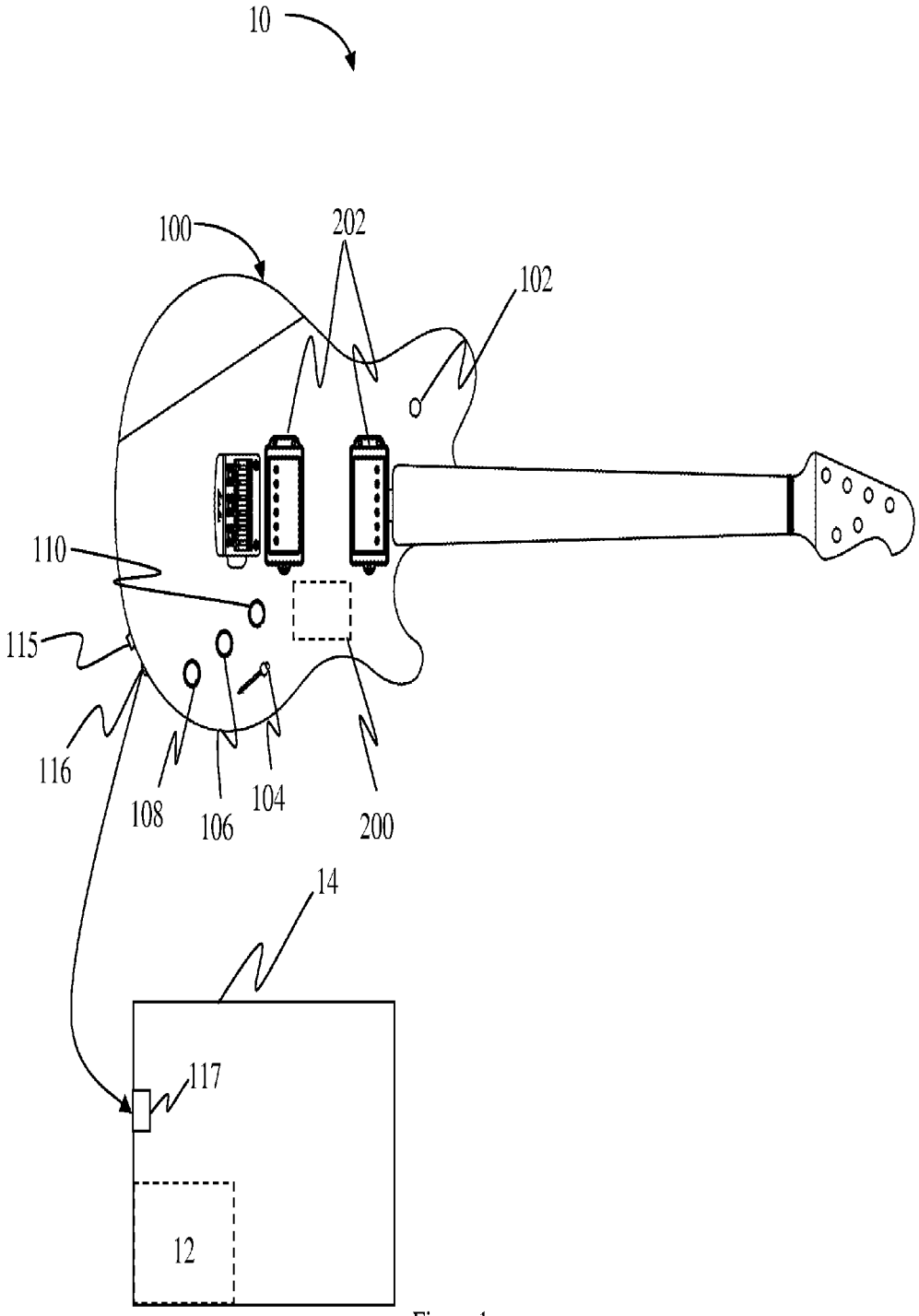
FIG. 1 is a diagram of a musical instrument having features of the invention.

As illustrated in FIG. 1, the control circuit 200 is disposed within a musical instrument 100. The software program 12 can either be disposed within the musical instrument 100 or disposed external to the musical instrument 100. In the embodiment illustrated in FIG. 1, the software program 12 is disposed within a computing device 14 that is external and spaced apart from the musical instrument 100. The term "computing device" as used in this application includes, but is not limited to, computers, cellular phones, handheld computers and other devices that are capable of executing programmed instructions contained in a storage medium, including machine readable medium.

The software program 12 is adapted to allow the user to select various options for modifying the characteristics of the musical instrument 100. The term "characteristic" as used in this application refers to the tone, quality, voice, volume, resonance and other indicia of an instrument that produce a desired sound.

In a typical embodiment, the software program 12 has user selectable options for modifying the characteristics of the musical instrument 100 which can comprise a) an option for setting the musical instrument 100 in a predetermined fashion for a desired tonality, characteristics and volume, b) an option for assigning a bank of presets to a specific switch on the musical instrument, c) an option for setting each preset to a specific switch position on the musical instrument, d) an option for assigning an instrument scheme to all presets and banks of the musical instrument 100, and/or e) an option for assigning a specific functionality to a specific control or switch on the musical instrument 100.

The musical instrument 100 illustrated in FIG. 1 further comprises various controls and switches 102, 104, 106, 108 and 110 for adjusting the characteristics of the musical instrument. The controls and switches 102-110 are operable to adjust the characteristics of the musical instrument 100 without altering the analog audio produced by the musical instrument 100. The controls and switches 102-110 can be multifunctional switches which are alternatively connected to the microprocessor 212 and to the switching matrix 204. In the embodiment illustrated in FIGS. 1 and 2, the controls and switches 106, 108 and 110 are multifunctional switches which are connectable to the microprocessor 212 to act as instrument control switches, and are alternatively connectable to the switching matrix 204 to control passive tone control and active tone control (control and switch 106), blend control (control and switch 108) and volume control (control and switch 110).

The musical instrument illustrated in FIG. 1 also comprises an audio output jack 115 for attaching the musical instrument 100 to an amplifier, headphones or the like.

The musical instrument 100 illustrated in FIG. 1 is a guitar. However, other instruments can be adapted for use in the invention, as well.

As best seen in FIG. 2, the control circuit 200 of the invention comprises the plurality of instrument pickups 202 for transmitting analog audio, and one or more controller connectors 116 for allowing connection of the control circuit 200 to the computing device 14.

Embodiments of the control circuit 200 can be implemented by a wide variety of methods known to those in the art, including hardware, software, firmware, middleware, microcode, or a combination thereof. When implemented in software, firmware, middleware or microcode, the program code or code segments to perform the necessary tasks can be stored in a machine-readable medium such as a storage medium or other storage(s). One or more than one processor or programmable microcontroller 212 can perform the necessary tasks. A code segment can represent a procedure, a function, a subprogram, a program, a routine, a subroutine, a module, a software package, a class, or a combination of instructions, data structures, or program statements. A code segment can be coupled to another code segment or a hardware circuit by passing and/or receiving information, data, arguments, parameters, or memory contents. Information, arguments, parameters, data, etc. can be passed, forwarded, or transmitted through a suitable means including memory sharing, message passing, token passing, network transmission, etc.

The control circuit 200 circuit typically further comprises pickup wiring, preamp routing, and output routing. The control circuit 200 is adapted to provide the ability to alternatively connect different subcircuits of the pickup wiring, preamp routing, and output routing to one another. Preferably, the control circuit 200 for combining and routing analogue audio can combine each of the plurality of instrument pickups 202.

In the musical instrument 100 illustrated in FIG. 1, the one or more controller connectors 116 can comprise a USB connection, an 8-pin DIN connector (used to send/receive digital data and potential audio signals—analogue or digital), a multi-pin connector, stereo ¼ inch output jacks for analogue audio signals, or such other connective devices yet to be developed which allow the operative connecting of the control circuit 200 to the computing device 14. An interface port 117 is typically used to allow connection between an external computing device 14 and the one or more controller connectors 116.

The control circuit 200 further comprises a) a digitally controlled analog switching matrix 204 connected to the control circuit 200, b) the microcontroller 212 connected to the digitally controlled analog switching matrix 204, c) a power supply 220, d) an audio mixer 224, e) an audio buffer 226, and f) one or more than one output 228 connected to the control circuit 200.

Typically, the plurality of musical instrument pickups 202 are selected from the group comprising a humbucker pickup, a single coil pickup, a piezoelectric pickup and a microphone pickup. Other musical instrument pickups 202 can also be employed in the invention.

Instrument 100 typically further comprises an audio mixer 224 to provide a means to combine a plurality of audio signal sources into one composite signal such that the level of any one of the individual signal sources has no effect on the level or frequency characteristics of the other signal sources.

Also, an audio buffer 226 can be employed as an isolation stage for conditioning the one or more audio signals. The one or more than one output 228 provides a connection to transmit one or more than one audio signal out of the musical instrument.

In the embodiment illustrated in FIG. 2, the plurality of instrument pickups 202 are connected to the switching matrix 204. The switching matrix 204 is configured to route audio generated by the instrument pickups 202 in all combinations, including serial combinations, parallel combinations, in phase combinations, and out of phase combinations and any combination of combinations.

The switching matrix 204 is operably connected to one or more than one of the controls and switches 102-110 so as to allow the instrument controls and switches 102-110 to be used to alter the characteristics of the musical instrument and can mix various characteristics with each other to produce unique sounds.

The switching matrix 204 can optionally be operably connected to a piezo-electric pickup preamp output 206. In such embodiment, the audio generated by the instrument pickups 202 can be mixed with the piezo-electric pickup preamp output 206.

The switching matrix 204 can also route the audio generated by the instrument pickups 202 through a passive preamplifier 208, an active preamplifier 210 or both a passive preamplifier 208 and an active preamplifier 210.

Still further, the switching matrix 204 can be optionally connected to a microphone pickup and preamplifier 222, an audio mixer 224, an audio buffer 226, or one or more than one output 228.

As noted above, the control circuit 200 further comprises a programmable microcontroller 212 operably connected to the switching matrix 204. The programmable microcontroller 212 is also operably connected to an external memory 214 storage for storing settings of the switching matrix 204. The external memory 214 comprises one or more devices for storing data, including read-only memory (ROM), random access memory (RAM), magnetic disk storage mediums, optical storage mediums, flash memory devices and/or other machine readable mediums for storing information. The term "machine readable medium" includes, but is not limited to portable or fixed storage devices, optical storage devices, wireless channels and various other mediums capable of storing, containing or carrying instruction(s) and/or data.

The programmable microcontroller 212 is used for selecting and storing information from the system presets and banks. The term "preset" refers to a single setting that "wires" the musical instrument in a predetermined fashion for a desired tonality. This can include, but is not limited to pickup wiring, preamp routing, and output routing. Each setting can be allocated to a specific switch position. The term "bank" refers to all presets assigned to a specific switch.

The switching matrix 204 combines and routes the signal path of the inputs through any of the controls, mixer, and/or buffer, to the output. The power supply unit 220 energizes the control circuit 200 and enables the routing and combining of the input signals. The power supply 220 can be energized in any manner currently known in the art. The control circuit 200 can be connected to the computing device 14, such as, for example, a smartphone, through any known wired or wireless means, such as, for example, universal serial bus (USB), Bluetooth® or WiFi among others. The control circuit 200 can have information transferred to and from the programmable microcontroller 212 or the external memory 214 to change banks, presets or musical instrument schemes by manual selection of controls and switches 102-110, the computing device 14 or both manual selection of the controls and switches 102-110 and the computing device 14.

The programmable microcontroller 212 can be activated by a user using the musical instrument controls and switches 102-110 to recall previously saved switching matrix 204 settings to configure the musical instrument 100 to output selected characteristics. Additionally, individual musical instrument controls and switches 102-110, can be configured, or assigned, by the user to save or recall one or more than one routing or mixing combinations, functions, actions or other information stored in the external memory 214.

The programmable microcontroller 212 can also be programmed using external means by way of the software program 12 loaded onto the computing device 14 using digital communications protocols 218 connected to the programmable microcontroller 212. As will be appreciated by those with skill in the art, the digital communications protocols 218 can be any applicable protocol, such as, for example, universal serial bus (USB), musical instrument 100 digital interface (MIDI), or universal asynchronous receiver/transmitter (UART) among others. The digital communications protocols 218 can be use by any computer, smartphone, or Internet device capable of connecting to the programmable microcontroller 212 using the selected protocol 218. The programmable microcontroller 212 can also be controlled using musical instrument control board devices external to the musical instrument thereby providing greater flexibility and control of the musical instrument 100.

As noted above, the programmable microcontroller 212 is also operably connected to the power supply unit 220, whereby the power supply unit 220 provides power to the control circuit 200. The programmable microcontroller 212 can be pre-programmed to power down the control circuit 200 to ensure that a proper shutdown procedure is followed, or after a prolonged period of inactivity to conserve energy. Additionally, the power supply 220 can provide digital power, analog power or both digital and analog power to the control circuit 200. The digital and analog power provided by the power supply 220 can be used for any component contained within the musical instrument 100 or connected to the musical instrument 100.

Stored settings in the external memory 214 can be recalled and activated by the programmable microcontroller 212 using the musical instrument controls and switches 102-110 mounted on the musical instrument 100, such as, for example, the controls and switches 102-110 on a conventional guitar. Moreover, the external memory 214 can comprise instructions for programming the programmable microcontroller 212, or be used by the microcontroller 212 as storage. In this embodiment, the controls and switches 102-110 mounted on the musical instrument 100 are used as digital inputs to control the programmable microcontroller 212, not as mechanical switches, for controlling the audio generated by the instrument pickups 202. Analog inputs are also provided to the switching matrix 204 from the controls and switches 102-110 that are dual purpose providing both analog and digital signals to the switching matrix 204. Further, all the controls and switches 102-110 can have programmable functionality so that the individual setting of the controls or switches 102-110 sends instructions to the microcontroller 212 to alter the characteristics of the musical instrument 100. Typically, there is provided a muting circuit used to ground the audio and control signals to silence the musical instrument 100 when the user operates a selected one of the available controls and switches 102-110. The functionality provided by the controls and switches 102-110 to alter the characteristics of the musical instrument 100 can also include assigning a bank of presets to a specific switch on the musical instrument 100, setting each preset to a specific control and/or switch 102-110 position on the musical instrument 100 and assigning a scheme to all presets and banks of the musical instrument 100 among others. As can be appreciated, the number and amount of functionality that can be assigned and/or stored is limited to the number of controls on the musical instrument 100. The number and amount of functionality that can be assigned and/or stored using a computing device 14 connected through the one or more than one control connector 116 is only limited by the software program 12 installed on the computing device 14.

The switching matrix 204 can also comprise one or more than one switch matrix integrated circuits (ICs) to route or combine the route audio generated by the instrument pickups 102. Although the switching matrix 204 and the programmable microcontroller 212 are digitally controlled, the audio generated by the instrument pickups 202 are not combined with any digital signals. These analog audio signals can be adjusted using dual purpose controls and switches 102-110 as inputs into the switching matrix 204. The digital control signals and analog audio signals are completely separate from one another so there is no emulation in the audio signal path.

A musical instrument can be played by a method comprising the steps of a) providing a musical instrument having the musical switching system of the invention 10, b) presetting the computing device to change one or more of the characteristics of the musical instrument, c) selecting one or more of the characteristics, d) activating the selected characteristics, e) playing the musical instrument with the selected characteristics, f) selecting a different characteristic than was selected in step c) on the external computing device, and g) repeating steps d through f.

Referring now to FIG. 3, there is shown a flowchart 300 of steps for one specific embodiment of the method of the invention for playing the musical instrument of the invention 100. First the musical instrument 100 and the control circuit 200 are provided to a user. Then, the user can preset the musical instrument 100 in step 302 using the controls and switches 102-110 provided on the musical instrument 100, or a computing device 14. Then, the microcontroller 212 is preset in step 304 to change one or more of the characteristics of the musical instrument 100. Next, in step 306, the user selects one or more of the characteristics to use while playing the musical instrument 100. Then, in step 308, the user activates the selected characteristics. Finally, the user plays the musical instrument 100 with the selected characteristics. While playing, the user can select different characteristics on the external computing device 14 or using the controls and switches 102-110 on the musical instrument 100, and then repeat the steps above to play the musical instrument 100 using the newly selected characteristics.

The invention provides the user with a myriad of important capabilities and functions, typically including, but not limited to:

- Capabilities to route audio signal generated by one or more instrument pickups in any/every possible combination of serial, parallel, in phase, and out of phase
- Capabilities to mix and route variations of the above with each other
- Capabilities to mix and route the above with a piezo pickup preamp output
- Capabilities to mix and route the above with a microphone pickup
- Capabilities to route the audio path through a passive or active preamp
- All of these routing/mixing combinations can be assigned to/recalled from any switch position
- Utilizes one or a combination of switch matrix ICs to perform some or all the above
- Utilizes a programmable microcontroller with ability to store settings in memory and recall them based on user input
- Utilizes digital inputs, outputs, and microcontroller to control analog audio signal
- Digital control signals and analog audio signals are completely separated
- There is no emulation in the audio signal path
- Off board programmability (web, PC, or mobile applications) via digital protocols (USB, MIDI, UART)
- Off board controlling of on board devices (application controlling microcontroller)
- On board controls are similar or exactly the same as conventional guitar/bass controls
- Can utilize conventional guitar/bass control switches as digital inputs, not mechanical switches directly in audio signal path
- All switches have programmable functionality
- Utilizes a "muting" circuit to silence signal when desired
- Circuit can power itself off to ensure proper shut-down procedure

Having thus described the invention, it should be apparent that numerous structural modifications and adaptations can be resorted to without departing from the scope and fair meaning of the instant invention as set forth hereinabove and as described hereinbelow by the claims.

What is claimed is:

1. A musical instrument switching system comprising:

a) a control circuit controllable for combining and routing a first analog audio signal and a second analog audio signal produced by the playing of a musical instrument, the control circuit comprising one or more musical instrument pickups for transmitting the first and second analog audio signals, and a controller connector for allowing connection of the control circuit to a computing device for generating a digital control signal configured to route the second analog audio signal through a digitally controlled analog switching matrix, wherein the digital control signal and the first analog audio signal are not combined;

b) an amendable software program configured for modifying the digital control signal to thereby modify the one or more audio characteristics of the musical instrument, the amendable software program configured to be amended by downloaded code segments; and c) a microcontroller connected to the digitally controlled analog switching matrix configured for combining the first and second analog audio signals into one or more composite signals.

2. The system of claim 1, where the one or more of musical instrument pickups are selected from the group comprising a humbucker pickup, a single coil pickup, a piezoelectric pickup and a microphone pickup.

3. The system of claim 1, where the control circuit further comprises:

a) a digitally controlled analog switching matrix connected to the control circuit;

b) an interface port connected to the control circuit for connecting a computing device;

c) a power supply connected to the control circuit to provide power; and d) an output connected to the control circuit for transmitting the composite signal out of the musical instrument.

4. The system of claim 1, where the control circuit can combine each of the one or more musical instrument pickups.

5. The system of claim 1, where the software program comprises user selectable options for modifying the characteristics of the musical instrument.

6. The system of claim 5, where the user selectable options for modifying the characteristics of the musical instrument further comprises:

a) an option for setting the musical instrument in a predetermined fashion for a desired tonality, characteristics and volume;

b) an option for assigning a bank of presets to a specific switch on the musical instrument;

c) an option for setting each preset to a specific switch position on the musical instrument;

d) an option for assigning a musical instrument scheme to all presets and banks of the musical instrument; and e) an option for assigning a specific functionality to a specific control on the musical instrument.

7. The system of claim 6 wherein the system further comprises pickup wiring, preamp routing, and output routing, and wherein the option for setting the musical instrument in a predetermined fashion for a desired characteristic provides the ability to operatively connect the pickup wiring, preamp routing, and output routing to one another.

8. The system of claim 1 wherein the computing device is an external computing device, in that it is not rigidly attached to the musical instrument.

9. The system of claim 1, wherein the musical instrument comprises a stringed musical instrument.

10. The system of claim 9, further comprising selectable options for modifying the characteristics of the musical instrument, the user selectable options further comprising:

a) an option for setting the musical instrument in a predetermined fashion for a desired tonality, characteristics and volume;

b) an option for assigning a bank of presets to a specific switch on the musical instrument;

c) an option for setting each preset to a specific switch position on the musical instrument;

d) an option for assigning a musical instrument scheme to all presets and banks of the musical instrument; and e) an option for assigning a specific functionality to a specific control on the musical instrument.

* * * * *